US008579080B2

(12) United States Patent
Angelico

(10) Patent No.: US 8,579,080 B2
(45) Date of Patent: Nov. 12, 2013

(54) ANTI-NOISE PANEL

(76) Inventor: Michele Angelico, Roncade (IT)

( * ) Notice: Subject to any disclaimer, the term of this patent is extended or adjusted under 35 U.S.C. 154(b) by 29 days.

(21) Appl. No.: 13/130,276

(22) PCT Filed: Nov. 19, 2009

(86) PCT No.: PCT/EP2009/065465

§ 371 (c)(1),
(2), (4) Date: Aug. 1, 2011

(87) PCT Pub. No.: WO2010/057945

PCT Pub. Date: May 27, 2010

(65) Prior Publication Data

US 2011/0308885 A1 Dec. 22, 2011

(30) Foreign Application Priority Data

Nov. 19, 2008 (IT) ..... TV2008A0148

(51) Int. Cl.

| | |
|---|---|
| ***E04B 1/82*** | (2006.01) |
| ***E04B 1/84*** | (2006.01) |
| ***E04B 2/02*** | (2006.01) |
| ***B29C 65/00*** | (2006.01) |
| ***B32B 37/00*** | (2006.01) |

(52) U.S. Cl.
USPC ..... 181/293; 181/286; 181/290; 181/294; 156/73.4

(58) Field of Classification Search
USPC ..... 181/293, 294, 286, 290; 156/73.4
See application file for complete search history.

(56) References Cited

U.S. PATENT DOCUMENTS

| | | | | | |
|---|---|---|---|---|---|
| 3,035,657 | A * | 5/1962 | Lemon | 181/290 |
| 3,077,426 | A * | 2/1963 | Johnston | 181/286 |
| 4,094,379 | A * | 6/1978 | Steinberger | 181/284 |
| 4,919,200 | A * | 4/1990 | Glomski et al. | 165/166 |
| 4,971,850 | A * | 11/1990 | Kuan-Hong | 428/137 |
| 5,394,786 | A * | 3/1995 | Gettle et al. | 86/50 |
| 5,744,763 | A * | 4/1998 | Iwasa et al. | 181/286 |
| 5,972,477 | A * | 10/1999 | Kim et al. | 428/175 |
| 6,584,736 | B2 * | 7/2003 | Szymanski et al. | 52/145 |
| 2002/0040827 | A1 * | 4/2002 | Kraft et al. | 181/293 |
| 2002/0175023 | A1 * | 11/2002 | Wilson | 181/293 |
| 2004/0154862 | A1 * | 8/2004 | Carlson | 181/293 |
| 2007/0238835 | A1 * | 10/2007 | Chen | 525/240 |
| 2009/0107059 | A1 * | 4/2009 | Kipp et al. | 52/144 |
| 2010/0180916 | A1 * | 7/2010 | Colon et al. | 134/18 |
| 2011/0139542 | A1 * | 6/2011 | Borroni | 181/290 |
| 2011/0284319 | A1 * | 11/2011 | Frederick et al. | 181/293 |

FOREIGN PATENT DOCUMENTS

| | | | | |
|---|---|---|---|---|
| JP | 2001051684 A | * | 2/2001 | G10K 11/16 |
| JP | 2003177758 A | * | 6/2003 | G10K 11/16 |
| JP | 2006030446 A | * | 2/2006 | |
| JP | 2006118259 A | * | 5/2006 | |

* cited by examiner

*Primary Examiner* — David Warren
*Assistant Examiner* — Christina Russell
(74) *Attorney, Agent, or Firm* — Egbert Law Offices, PLLC

(57) ABSTRACT

It is disclosed an anti-noise panel comprising a front shell and a rear shell that are coupled together within which rubber elements of specifically designed shape and size are incorporated. Said panel can be advantageously obtained by using also recycled, injected thermoplastic material, that allows the resulting panel to be conveniently used when the wind causes strong impact, for example, along railway lines where the compression waves generated by trains traveling at high speed over time tend to disassemble the riveted aluminum/steel sound barriers currently in use.

12 Claims, 11 Drawing Sheets

ANTI-NOISE PANEL

FIELD OF THE INVENTION

The present invention relates an anti-noise panel which can be used, for example, as a traffic noise barrier along roads, highways and/or railways. The panel according to the invention comprises a front shell and a rear shell, made of thermoplastic material, that are coupled together within which rubber elements of specifically designed shape and size are incorporated. Said panel can be advantageously obtained by using recycled, injected thermoplastic material, that allows the resulting panel to be conveniently used when the wind causes strong impact, for example, along railway lines where the compression waves generated by trains traveling at high speed over time tend to disassemble the riveted aluminum/steel sound barriers currently in use.

STATE OF THE ART

The construction features of the noise barriers currently in use do not satisfy today's requirements. Moreover, a great number of noise reduction solutions are produced with barriers that are very heavy and very expensive, but that nonetheless are not always suitable for a given area of application.

In order to establish the noise reduction efficiency of sound absorbing systems, reference should be made to the sound abatement performance parameters resulting from testing in free field conditions as set forth in the UNI 11022 standard which follows the same guidelines as the ISO 10847 standard, i.e. the noise in dB(A) measured at the receiving location with the barrier/noise absorption medium installed between the receiving location and the noise source. The unsuitability of certain barriers currently in use is due to the fact that several factors were considered marginal, or were not even taken into consideration, because they were not subjected to specific regulations until the new European Directives came into force. Said Directives in fact not only regulate noise pollution but also all types of environmental pollution, thus all barriers which are composed of materials that deteriorate rapidly must be replaced within a period estimated at around 2 to 3 years.

The types of barriers currently in use are typically made of the following materials: aggregate concrete, with vegetation or tire rubber granules there within; wood having a rock wool core; steel having a rock wool core; aluminum having a rock wool core; light alloy having a rock wool core; PMMA polymethylmethacrylate; polycarbonate; glass; fibre-reinforced polymer; composite materials/carbon fibre.

Different types of materials are used in function to market requirements, however it is not always possible to satisfy both aesthetic and noise reduction requirements. Most noise barriers currently in use belong to the following types: steel having a rock wool core; aluminum having a rock wool core; wood having a rock wool core; PMMA polymethylmethacrylate. Among the aforementioned types, steel having a rock wool core and aluminum having a rock wool core are the most commonly used. Noise barriers currently in use are generally composed of a metal or wood casing having perforations for the passage of sound waves and a rock wool core whose function is the absorption of the sound energy, or more precisely the energy present in sound waves of a range of frequencies and plainly not all the frequency spectrum.

The barriers currently in use are easy to manufacture but with a low level of automation; the technologies are known and the materials are easy to obtain but are getting increasingly costly; some can be customized in order to blend into the surrounding environment but only within certain limits.

However, the barriers currently in use indeed have many disadvantages that can be summarized as follows:

Disadvantages Regarding Performances:

They are extremely limited in terms of sound absorption efficiency as well as life cycle, which can be estimated at around 4 to 5 years; they require periodical maintenance; the installation is complicated and lengthy; the rock wool used is hazardous to health, and in fact is soon to be banned.

One of the main adverse point of said barriers is the fastening system because it must be specifically designed for each type of barrier.

Barriers currently in use are fitted into the cavity of the support structure but this is not sufficient to guarantee stability, therefore, bolts, anchors etc. are used on the side that does not face the noise source. The said barriers are made of different pieces, therefore their stiffness is insufficient, and moreover the fastening elements must be secured manually and this entails additional manufacturing costs. It is quite common to see a worker on a ladder or self-propelling platform carrying out maintenance, checking, tightening or replacing the fastening elements of barriers especially along railway lines where the compression wave generated by the passing of a train over time loosens the fastening elements, then often forces the barriers out of the support structure cavity and hurls them over the surrounding area, with all the risks entailed in the case of contact with persons because besides being heavy they also have sharp edges.

Disadvantages Regarding Maintenance Over Time:

Barriers currently in use require maintenance work, both in terms of cleaning to remove the dirt caused by atmospheric conditions and the dust caused by traffic, and accordingly periodical maintenance to ensure the efficiency of the fastening elements.

Disadvantages Regarding the Expected Life Cycle:

In addition to the fact that barriers that use rock wool on the inside are soon to be banned (in view of the Directives EN 1793-1, ISO/R 354-1985 and DIN 52212), such barriers also have a limited life cycle. Moreover, atmospheric conditions, and especially precipitation containing dust and pollutants seep into the rock wool causing deterioration of its physical/chemical properties and reducing its volume by more than 30%. Said deterioration reduces the useful life of the barriers to 4-5 years; firstly there a loss of sound adsorption efficiency, and then the rock wool dust, which is very hazardous to health, is released into the atmosphere.

It should be noted that most of the noise barriers are installed near cities and built-up areas and in many cases they are located practically alongside houses and residential apartment buildings.

Other Disadvantages:

An additional disadvantage of the barriers currently in use regards their manufacturing process, which is not fully automated therefore the workers involved in the process are exposed to the dust that is continually released from the rock wool when it is fitted into the barriers. Said barriers are open at the ends and have many perforations, thus any type of handling causes the release of rock wool dust into the air.

Another negative aspect of barriers currently in use concerns dismantling and disposal. The fact that said barriers are made of metal parts that are very costly (steel or aluminum) implies the recovery of said parts, which is a very difficult and expensive process because it involves separating the metal from the rock wool, which must then be disposed off.

It is therefore an object of the present invention to provide noise barriers that allow to overcome the drawbacks of the prior art as above reported.

SUMMARY OF THE INVENTION

This object has been achieved by the anti-noise panel as set forth in claim 1. The anti-noise panel of the present invention comprises a front shell and a rear shell, made of thermoplastic material, that are coupled together so as to form a sealed inner cavity, said panel incorporating dampers of specifically designed shape and size. By suitably joining the shells, the resulting panel has a one-piece structure that has been proved to be an extremely valid noise reduction solution, whereas being very cost effective as well as more efficient and longer lasting than the known noise barriers.

The present invention further relates to a process for the production of said anti-noise panel which comprises the steps of:

a) forming a front shell, optionally incorporating at least one damper, by injection moulding, b) forming a rear shell, optionally incorporating at least one damper, by injection moulding, and c) joining said front shell to said rear shell so that a inner cavity is formed, thus obtaining the anti-noise panel.

For the purposes of the present invention, by the phrase "front shell A" is meant a shell A exposed to the noise source.

BRIEF DESCRIPTION OF THE DRAWINGS

The characteristics and advantages of the present invention will be apparent from the detailed description reported below and the annexed Figures, wherein.

DETAILED DESCRIPTION OF THE INVENTION

The subject of the present invention is therefore an anti-noise panel comprising a structure incorporating at least one damper and comprising a front shell made of plastic material and a rear shell made by the same or different plastic material, said front shell being joined to said rear shell so as to form a sealed inner cavity.

Figure 1:
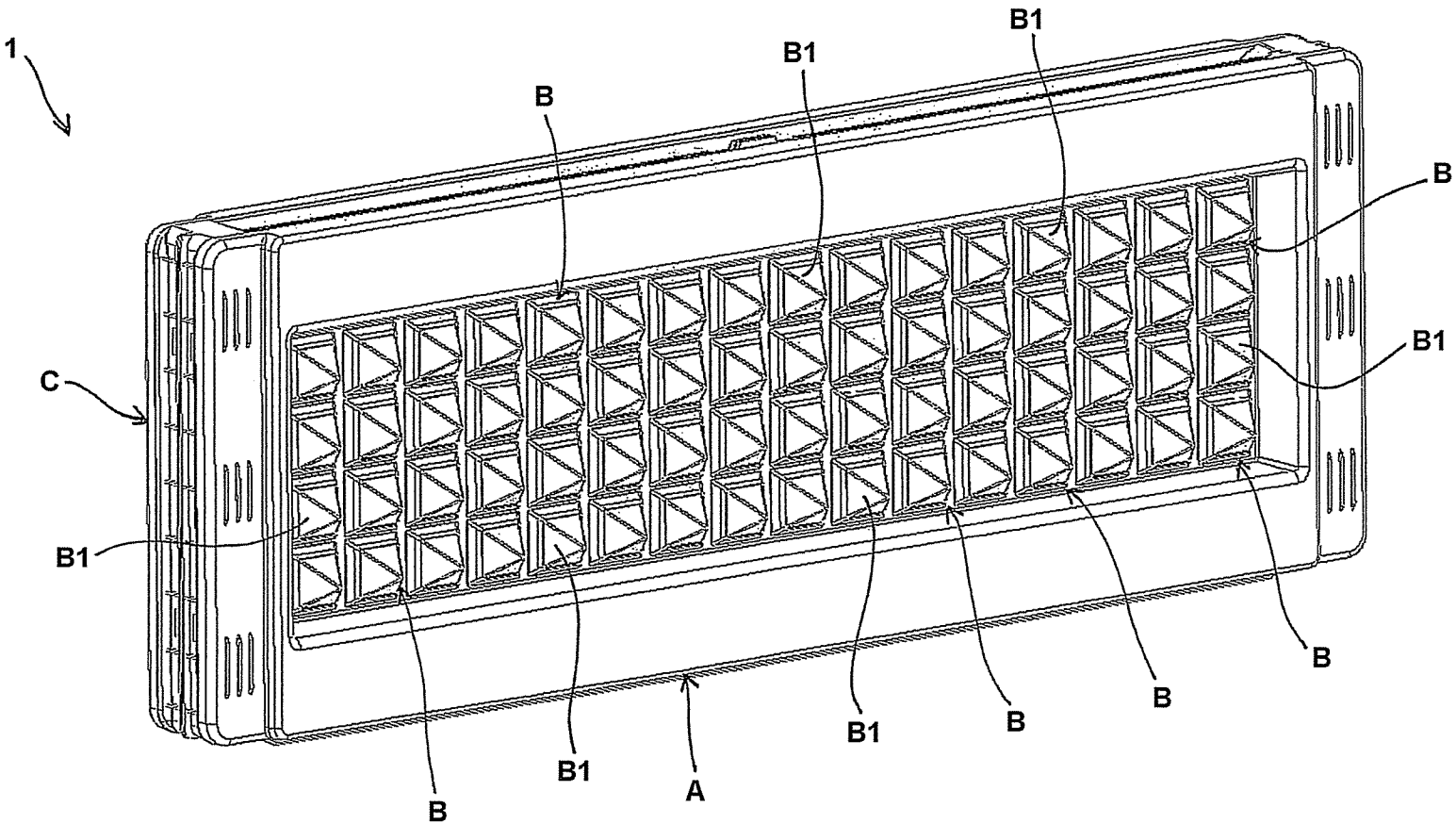
FIG. 1 shows a view of the front shell (A) of an anti-noise panel according to a first embodiment of the invention.

FIG. 1 shows a first preferred embodiment of the present invention, wherein said panel 1 comprises a front shell A made of thermoplastic material and a rear shell C made by the same or different thermoplastic plastic material. According to the invention, the front shell A and the rear shell C are joined together so as to form a one-piece structure having a sealed inner cavity IC.

The internal and external configurations of the panel 1 are designed by making reference to features of an anechoic chamber. Preferably, the inner cavity IC has a labyrinth configuration.

In the present invention, by "thermoplastic material" is meant a material capable of softening or fusing when heated and of hardening again when cooled. Exemplary thermoplastic materials include organic synthetic polymers, elastomers and compounds thereof.

Front shell and rear shell are preferably made of thermoplastic organic polymers or compounds thereof, that are rigid once thermoformed, such as polymethylmethacrylate (PMMA), Acrylonitrile Butadiene Styrene (ABS), polystyrene (PS), High Density Polyolefins, Polyvinyl Chloride (PVC), Chlorinated Polyvinyl Chloride (CPVC), Polyvinylidene Fluoride (PVDF), Polycarbonate (PC), Polyammide (PA), Polybutylenethereftalate (PBT), Polyethylenethereftalate (PET) or compounds thereof. More preferred thermoplastic organic polymers are polymethylmethacrylate (PMMA), polypropylene (PP), mixtures thereof, or compounds of (ABS)-(PC).

Preferably, the at least one damper of the anti-noise panel 1 is made of thermoplastic elastomers or compounds thereof. Said elastomers are used as having three essential characteristics:

- capability to be stretched to moderate elongations and, upon the removal of stress, return to something close to its original shape,
- processability as a melt at elevated temperature, and
- absence of significant creep.

Preferred thermoplastic elastomers are natural, semisynthetic or synthetic rubber or blends of said rubber with other thermoplastic elastomers, such as Styrene Ethylene Propylene Styrene (SEPS), Styrene Butadiene, Acrylonitrile Butadiene, or Styrene Isoprene Styrene (SIS).

More preferred elastomers are synthetic rubber, such as ethylene propylene diene monomer (EPDM) or blends of the same with other thermoplastic elastomers.

Advantageously, the shell A or the shell C or both can be made of recycled thermoplastic material. According to a preferred embodiment of the present invention, the shells A and C of the anti-noise panel 1 are made of 100% recycled thermoplastic material, thus being very low-cost and environmental-friendly. Actually, according to this embodiment, conveniently no aluminum or steel and/or ferrous materials are used.

Optionally, the above thermoplastic material can be blended with at least one inert filler. The inert filler can be chosen from talc, calcium carbonate, glass spheres, graphite, carbon black, carbon fiber, glass fiber, wollastonite, mica, alumina, silica, and silicon carbide.

The thermoplastic material according to the present invention can also include additives such as lubricants, flame retardants, heat and UV/Light stabilizers, dimensional stabilizers, waxes, colorants, foaming agents, impact modifiers, corrosion inhibitors, anti-static agents, plastic processing aids, anti-fog agents, anti-oxidants, anti-block, slip additives, mould release agents, or mould coating agents.

Figure 2:
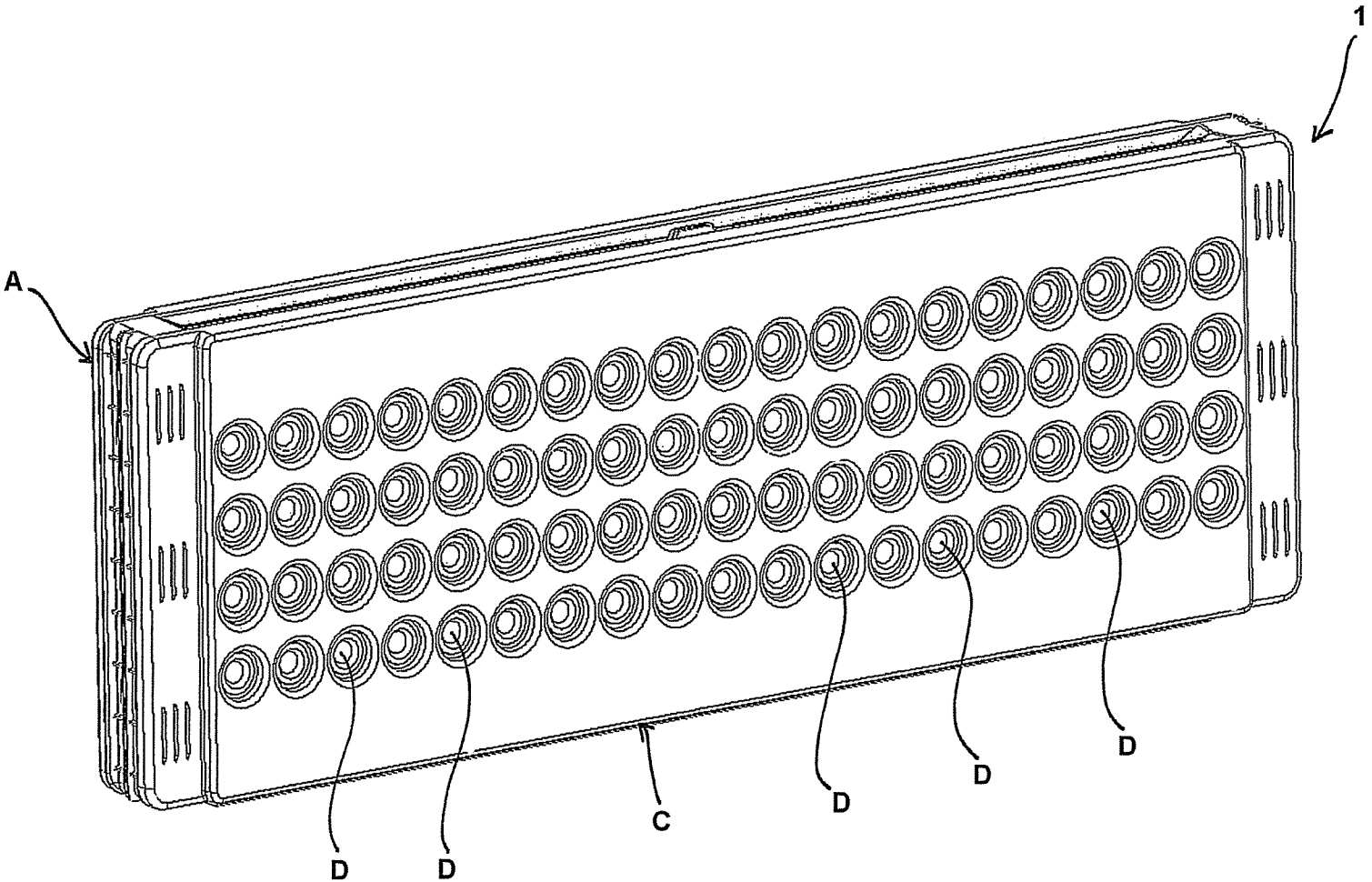
FIG. 2 shows a view of a rear shell (C) of the anti-noise panel according to said first embodiment of the invention.
Figure 3:
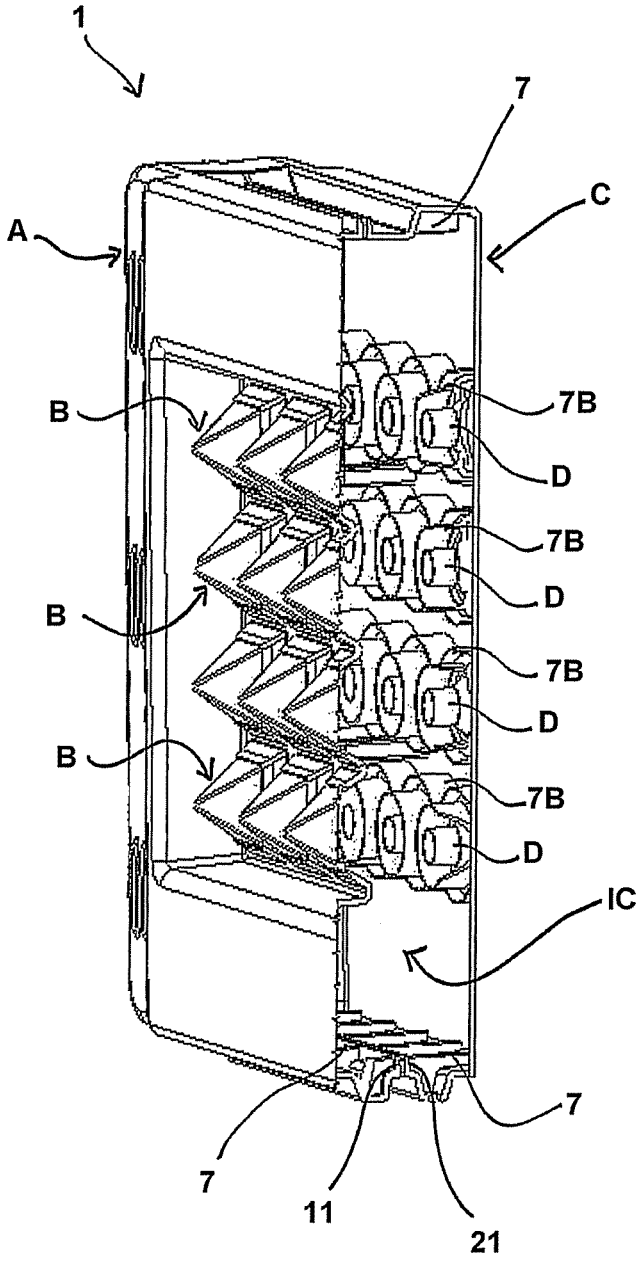
FIGS. 3 and 4 show a portion of the anti-noise panel as well as elements composing the same according to said first embodiment.
Figure 4:
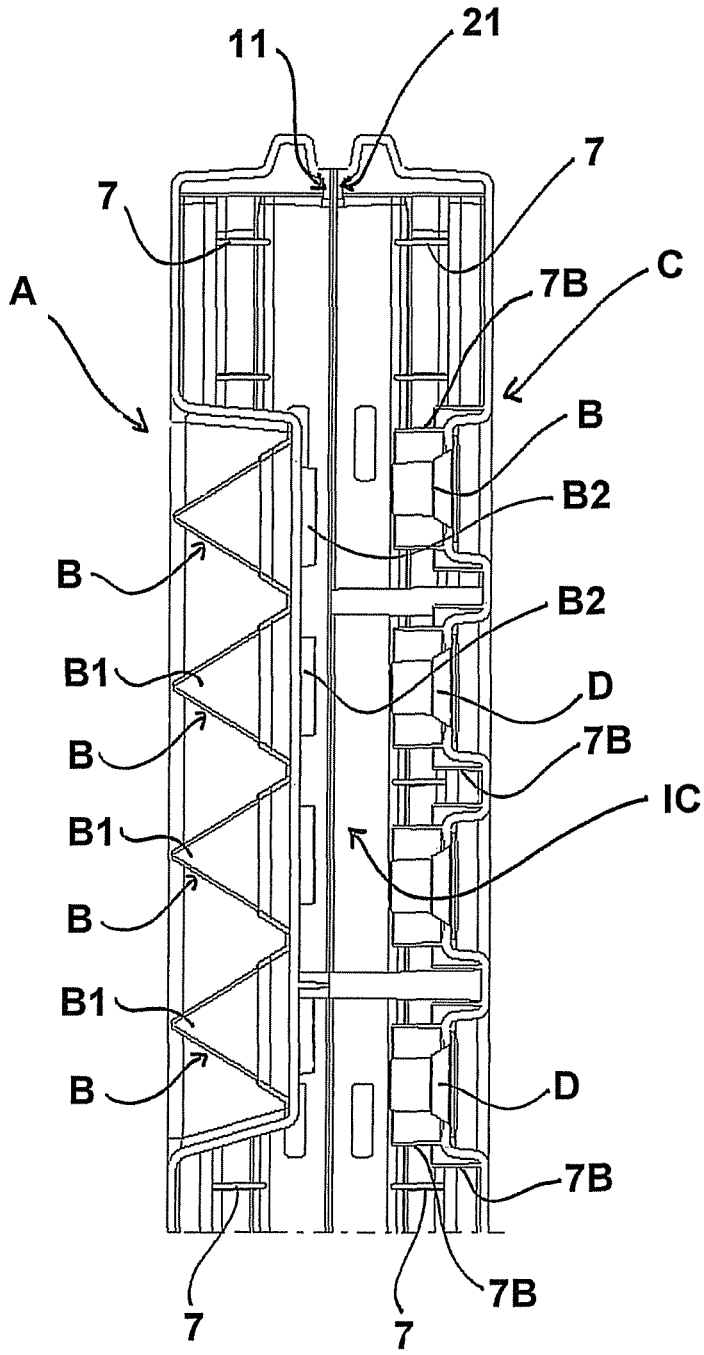

FIGS. 1 to 5 are relative to a first embodiment of the anti-noise panel 1 according to the invention having a plurality of dampers. With reference in particular to FIGS. 1 and 2, the anti-noise panel 1 comprises a first plurality of dampers B on the said front shell A. Hereinafter this dampers B are also indicated with the expression "external dampers B" since they comprise an external part B1 which actually protrudes outwards of the sealed inner cavity IC. FIG. 1 and the section view of FIG. 4 show a preferred shape of these dampers B according to which the external part B1 has a pyramidal shape having a square base.

Figure 5:
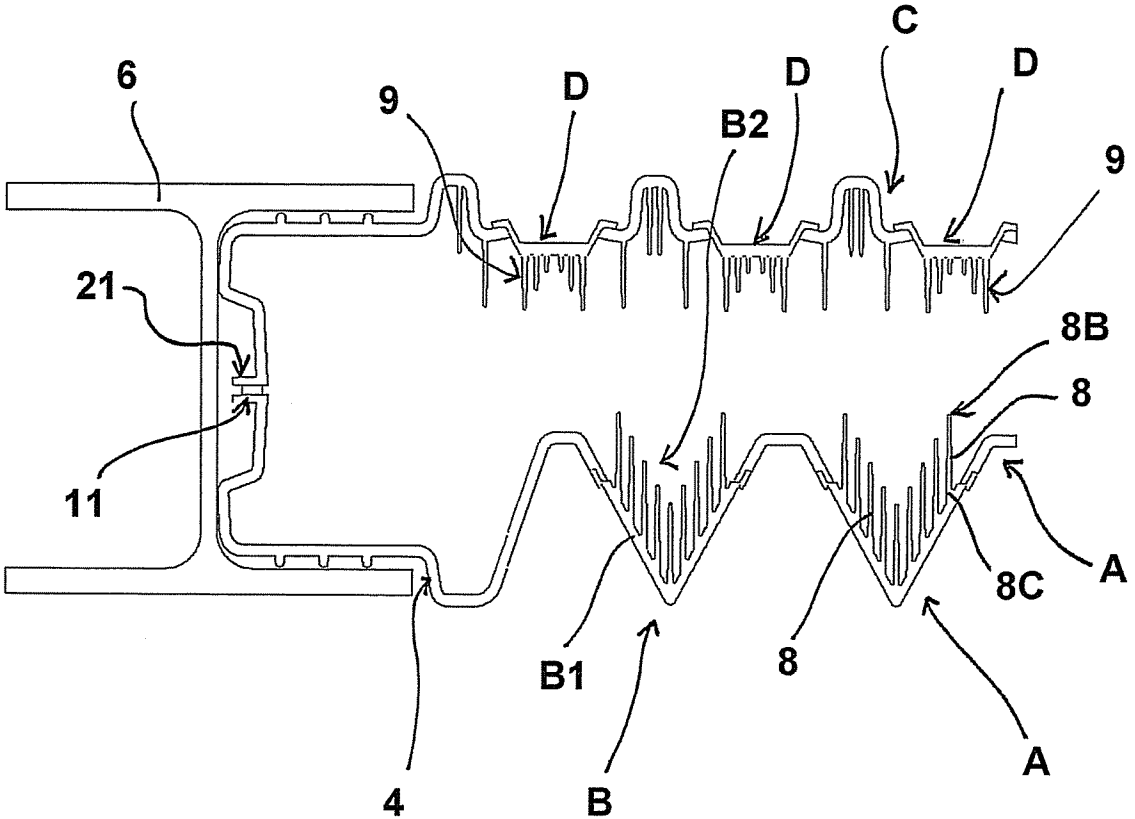
FIG. 5 shows a section view of the anti-noise panel of FIGS. 3 and 4.
Figure 6:
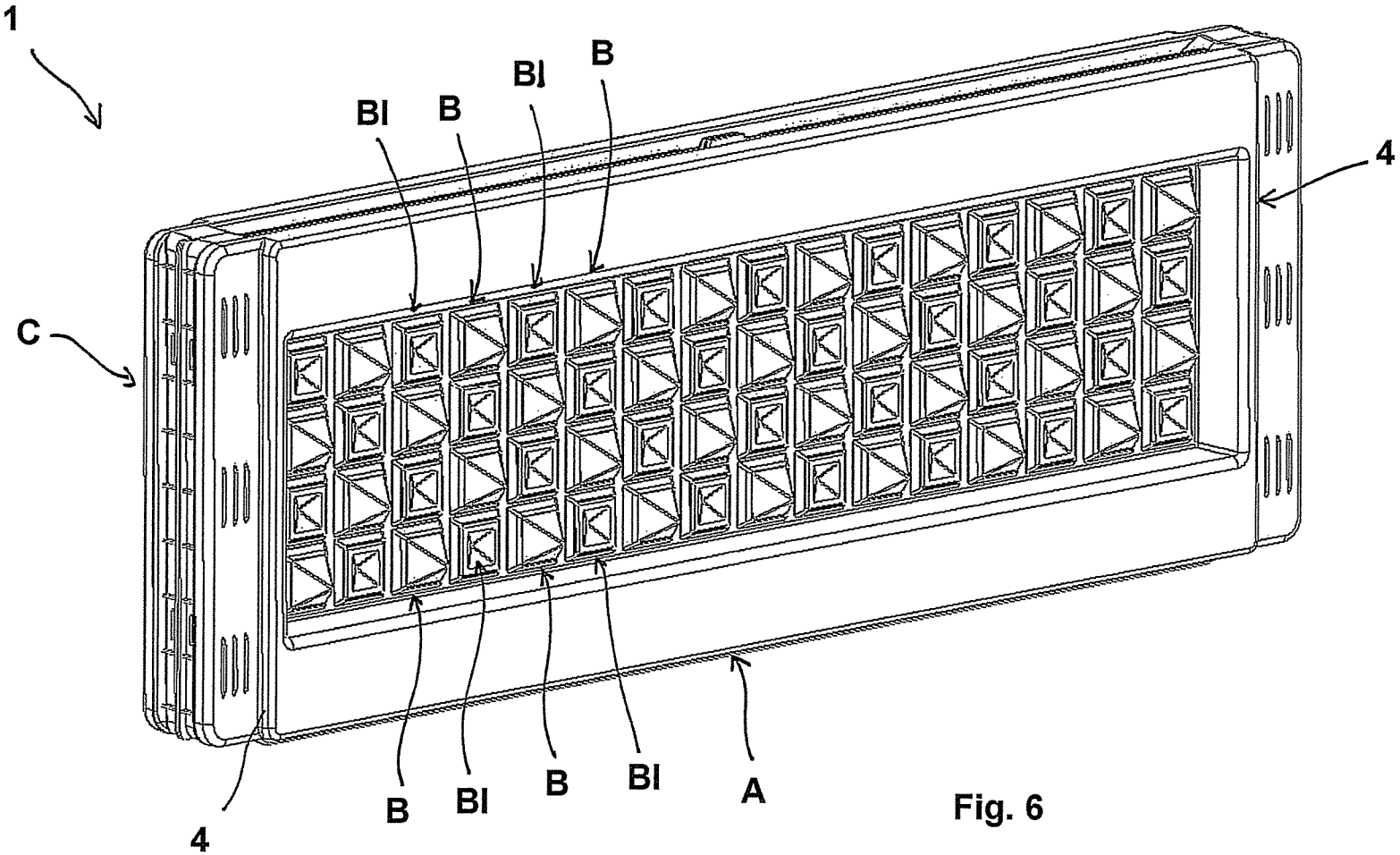
FIG. 6 shows a view of the front shell (A) of an anti-noise panel according to a second embodiment of the invention.
Figure 7:
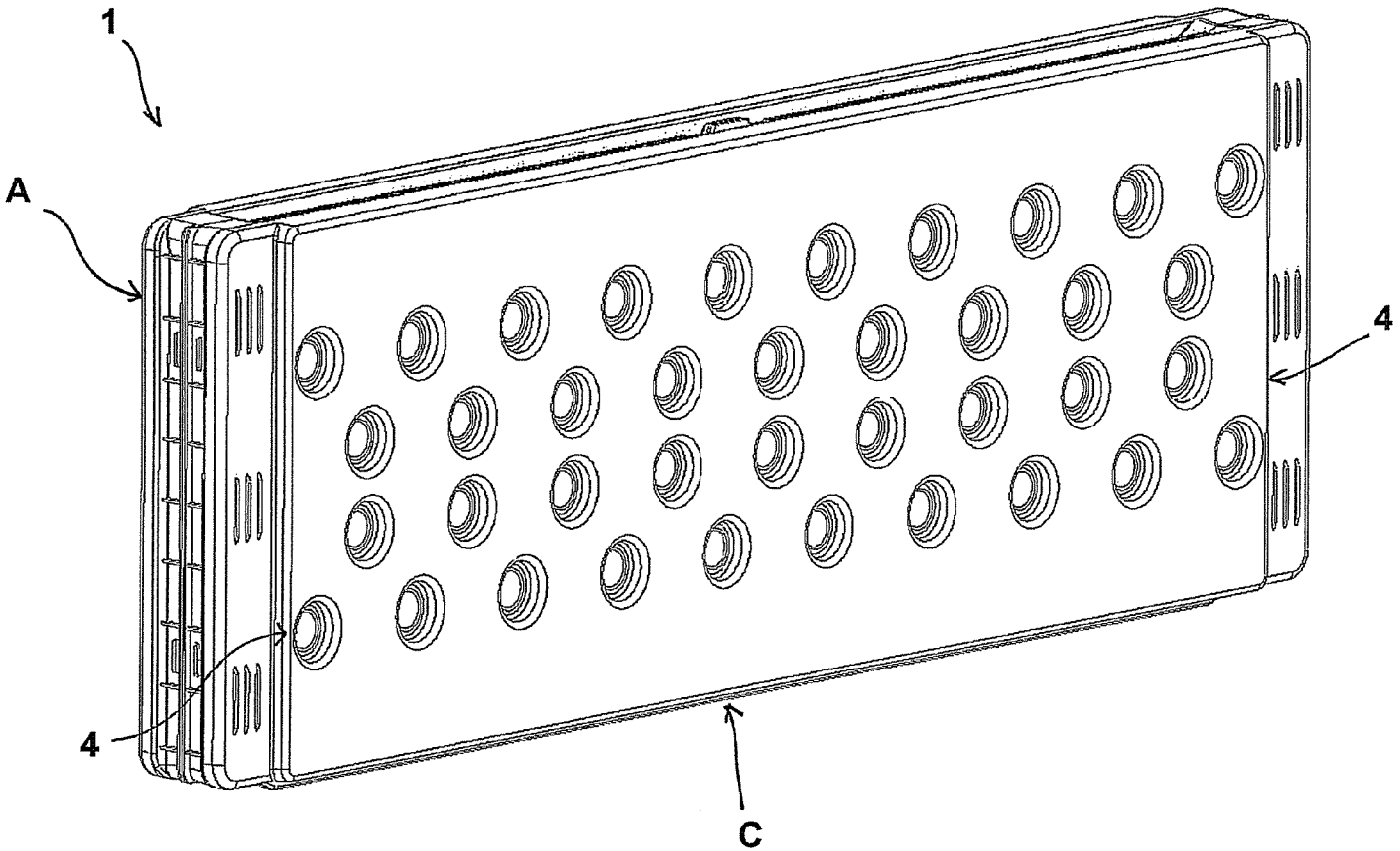
FIG. 7 shows a view of a rear shell (C) of the anti-noise panel according to said second embodiment of the invention.

With reference in particular to the section view of FIG. 5, the external dampers B comprises also an internal part B2 which protrudes inwards of the inner cavity IC. The internal part B2 of the dampers B comprises lamellae 8 having different thickness and length that advantageously allow to absorb the energy deriving from sound waves of the relevant frequencies. In fact, said lamellae 8 dissipate the energy absorbed by means of vibration at the tip 8B of said lamellae 8 which is tapered from the base 8C.

According to the first embodiment shown in FIGS. 1-5, the anti noise-panel 1 also comprises a plurality of internal dampers D which are incorporated in the rear front shell C. Hereinafter, these dampers D are indicated with the phrase "internal dampers D" since they develop substantially inwards the sealed inner cavity IC as clearly shown, for example, in FIG. 5. As illustrated, the shape and size of the internal dampers D are different from those of the external dampers B incorporated in the front shell A. The internal dampers D are interpositioned between the external dampers B in such a way as to cover as much space as possible on the inside of the sealed inner cavity IC of the anti-noise panel 1.

With reference to FIG. 5, the internal dampers D are smaller than and have a different shape with respect to that of the external dampers B, because they are intended to absorb the energy deriving from sound waves of different ranges of frequencies. In particular, in the illustrated embodiment, the internal dampers D are formed as cylindrical coaxial bodies 9 which develop inward of the sealed inner cavity IC.

Figure 11:
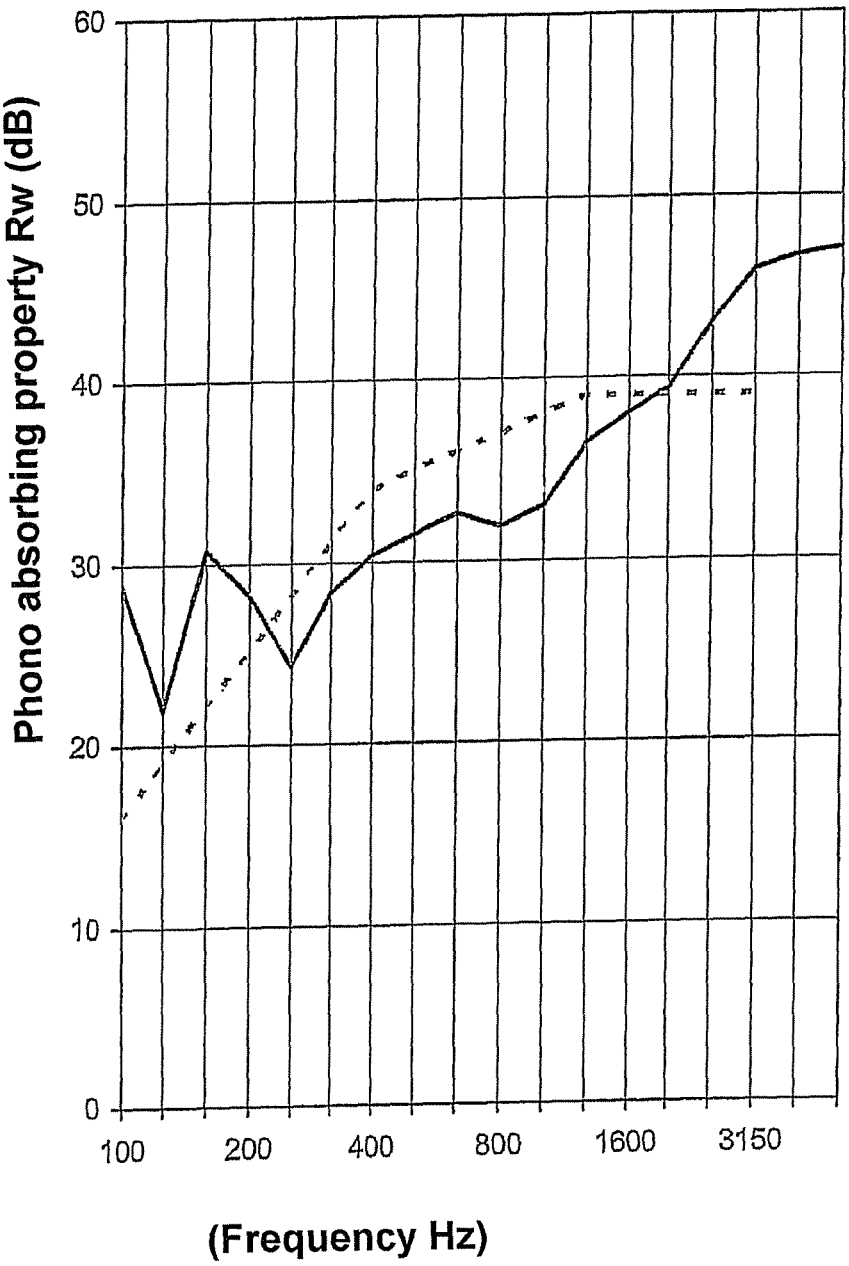
FIG. 11 shows a diagram illustrating the phono-absorbing property of an anti-noise panel according to the invention over the frequency spectrum of the sound waves.

FIG. 11 is a diagram illustrating the phono-absorbing property Rw(dB) of the anti-noise panel 1 over the frequency spectrum of the sound waves. Said diagram has being plotted according to ISO 717-1 (in the range 100 to 3150 Hz) by detecting experimental measurements. In the diagram, the broken line identifies the standard of ISO 717-1, whereas the continuous line is the characteristic trend detected for the anti-noise panel 1 according to the invention. As shown by the diagram, the phono-absorbing property is advantageously greatly satisfactory over all the range of frequencies 100 up to 3150 Hz, being even conveniently higher than what required by the standard in the range of frequencies up to 300 Hz and in the range beyond 1600 Hz. In particular, it has been observed that the external dampers B, incorporated in the front shell A, are quite successfully effective in absorbing the energy deriving from sound waves on the range up to 1600 Hz, while the internal dampers D incorporated of the rear shell C, improve said absorption of energy deriving from sound waves beyond 3000 Hz.

With reference to FIG. 4, the front shell A and the rear shell C comprise stiffening ribs 7, in order to further improve the structural strength of the panel 1 especially against specially adverse circumstances of impacts or collisions. In particular, these stiffening ribs 7 develop inwards of the inner cavity IC and along one or more internal sides of corresponding shell A, C. The rear shell C also comprises cylindrical stiffening ribs 7B which develop inward the inner cavity IC substantially around corresponding internal dampers D.

The outer surface of the front shell A comprise two parallel rest surface 4 defined at opposite ends which can be used to simplify the assembly of the panel on suitable support structure 6 like that shown in FIG. 5. Analogously, also the outer surface of the rear shell C comprise two similar rest surface with the same purposes.

Figure 8:
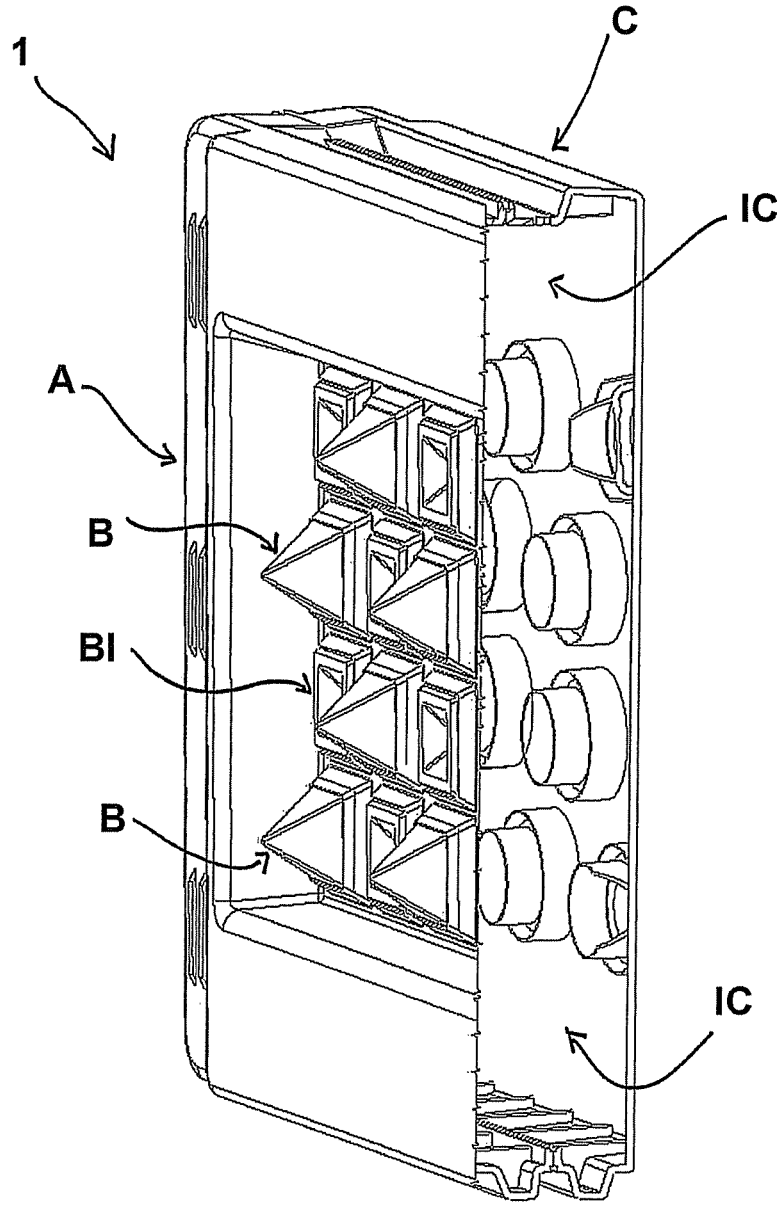
FIGS. 8 and 9 show a portion of the anti-noise panel as well as elements composing the same according to said second embodiment.
Figure 9:
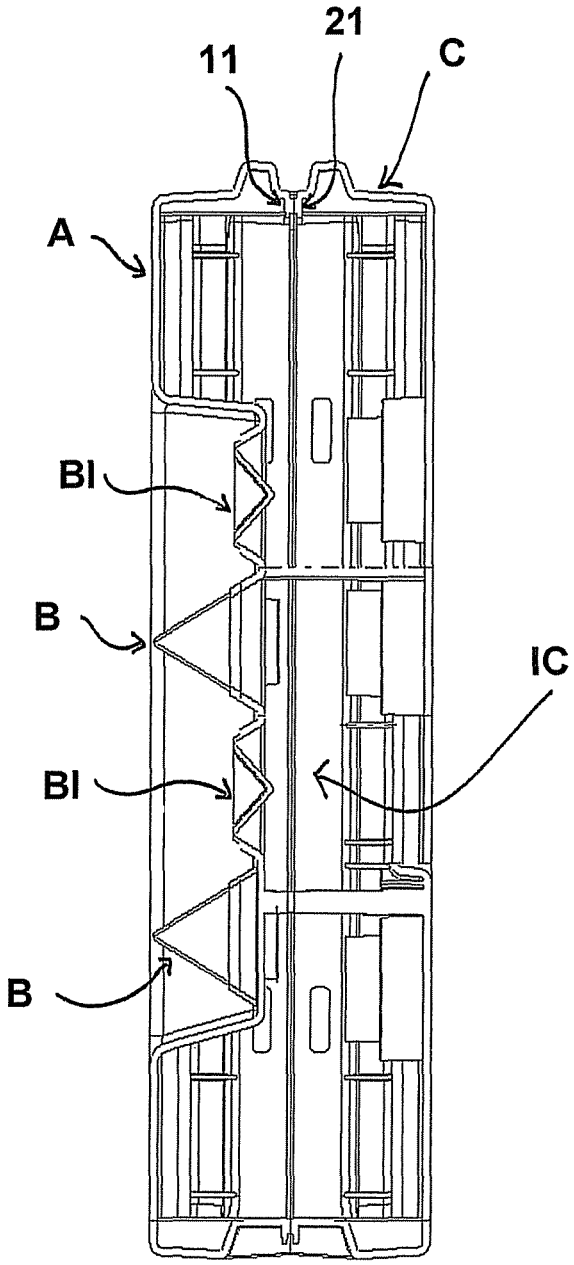
Figure 10:
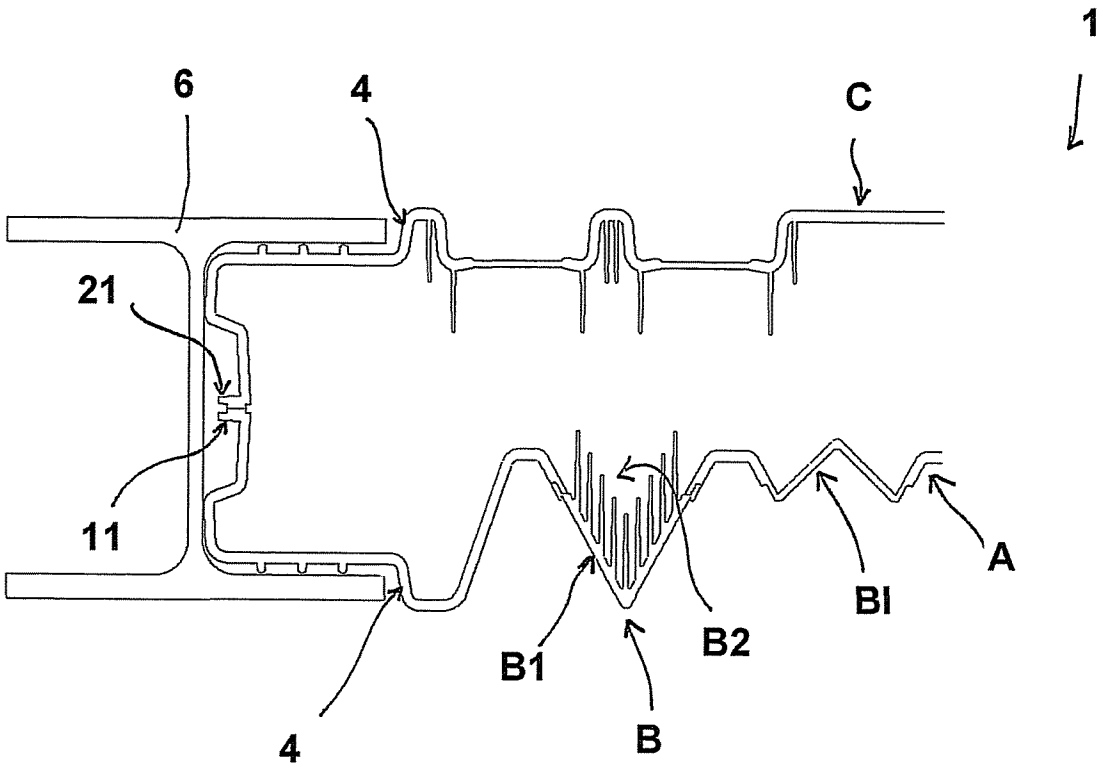
FIG. 10 shows a section view of the anti-noise panel of FIGS. 8 and 9.

FIGS. 6 to 10 are relative to a second embodiment of the anti-noise panel 1 according to the present invention. As shown for example in FIG. 6, in this case panel 1 comprises a first plurality of external dampers B incorporated on the front shell A and substantially equivalent to those relative to the first embodiment above describe. In this case the panel 1 comprises also a second plurality of external dampers BI always incorporated on the front shell A. The dampers B of the first plurality and those BI of the second plurality are reciprocally spaced according to orthogonal directions. FIGS. 8 and 9 show the configuration of these dampers BI of the second plurality which have a pyramid shape protruding inwards of the inner cavity IC. In particular, the dampers BI are preferably made of thermoplastic material which can be equivalent or different to the material used for the front shell A. In other words, according to this embodiment, the first plurality of dampers B is made of thermoplastic rubber and the second plurality of dampers BI is made of thermoplastic material.

In this second embodiment, the rear shell C does not incorporate any dampers. Experimental measurement have proved that the performances of the panel 1 according to the second embodiment, even if not so excellent as in the case of the first embodiment, however are highly satisfactory and conveniently effective in adsorbing noise, i.e. by only using the first plurality of dampers B and the second plurality of dampers BI both incorporated on the front shell A.

As illustrated in the section views of FIGS. 8 and 9, the configuration of the shells A, C in the second embodiment is substantially equivalent to that of the first one. Consequently, common elements relative to both embodiments are indicated in FIGS. 6-10 by using the same references used in the FIGS. 1-5. The one-piece structure of the anti-noise panel of the present invention and the successful sound absorption proved above allow to overcome the drawbacks of the prior art panels.

In a further aspect, the present invention relates to a process for manufacturing the anti-noise panel as above described, comprising the steps of a) forming a front shell A, optionally incorporating at least one damper, by injection moulding, b) forming a rear shell C, optionally incorporating at least one damper, by injection moulding, and c) joining said front shell A to said rear shell C so that a sealed inner cavity is formed, thus obtaining the anti-noise panel.

The above process allows the at least one damper to be incorporated in the front shell A and/or in the rear shell C during the manufacturing of the shell themselves. In this regard, the shells A, C can be simultaneously manufactured by means of a bi-injection moulding.

As above indicated, the front shell A and the rear shell C form a sealed inner cavity IC, once said shells are joined. The shells A, C are preferably joined by fitting together the respective perimeter edge 11, 21. More precisely, the front shell A comprises a first perimeter edge 11 which is preferably welded to a second perimeter edge 21 of the rear shell C (see for example FIG. 5). Conveniently, the first perimeter edge 11 has the same configuration, in terms of shape and size, of the second edge 21. In this manner, after joining the shell A to the shell C, the inner cavity IC directly results isolated and sealed and the resulting anti-noise panel is a one-piece structure.

The front shell A and the rear shell C are preferably joined by thermo-welding. In particular, the thermo-welding is preferably performed by means of a hot blade or alternatively by ultrasounds. According to a preferred embodiment, said at least one damper for intercepting the noise is not positioned after the said anti-noise panel is manufactured, thus being incorporating therein so as to form a one-piece anti-noise panel.

The said anti-noise panel is preferably produced in two automated stage. No screws nor rivets are preferably used for assembling the two shells, because assembly is conveniently achieved by means of an automated joining system. Preferably, no sound absorption materials are used, because noise reduction is successfully achieved by combining the anechoic chamber and the bi-injection moulding technology.

The technical solutions adopted for the anti-noise panel according to the present invention allow it to fully accomplish the object above indicated. The panel is reliable and is manufactured at competitive costs.

It will be apparent to the person skilled in the art that various modifications can be conceived and reduced to practice without departing from the scope of the invention.

The invention claimed is:

1. An anti-noise panel comprising:

a front shell formed of a thermoplastic material;

a rear shell formed of a thermoplastic material, said front shell joined to said rear shell so as to form a sealed inner cavity; and at least one damper incorporated on the front shell, said at least one damper having an external part that protrudes outwardly of said sealed inner cavity, said at least one damper having an internal part that protrudes inwardly of said sealed inner cavity, said external part having a pyramid shape with a square base.

2. The anti-noise panel according to claim 1, said at least one damper comprising a first damper incorporated on said front shell and a second damper incorporated on said rear shell.

3. The anti-noise panel according to claim 2, said second damper protruding inwardly of said sealed inner cavity.

4. The anti-noise panel according to claim 3, said second damper formed of a thermoplastic elastomer material.

5. The anti-noise panel according to claim 4, said second damper comprising a plurality of cylindrical coaxial bodies.

6. The anti-noise panel according to claim 1, said thermoplastic material of said first shell and said second shell selected from the group consisting of polymethylmethacrylate, acrylonitrile butadiene styrene, polystyrene, high density polyolefins, polyvinyl chloride, chlorinated polyvinyl chloride, polyvinylidene fluoride, polycarbonate, polyamide, polybutylenethereftalate, polyethylenethereftalate, and mixtures thereof.

7. The anti-noise panel according to claim 6, said thermoplastic material of said front shell and said rear shell selected from the group consisting of polymethylmethacrylate, polypropylene, compounds of acrylonitrile butadiene styrene and polycarbonate, and mixtures thereof.

8. The anti noise panel according to claim 1, said thermoplastic material of said front and rear shells being of a recycled thermoplastic material.

9. An anti-noise panel comprising:

a front shell formed of a thermoplastic material;

a rear shell formed of a thermoplastic material, said front shell joined to said rear shell so as to form a sealed inner cavity; and at least one damper incorporated on the front shell, said at least one damper having an external part that protrudes outwardly of said sealed inner cavity, said at least one damper having an internal part that protrudes inwardly of said sealed inner cavity, said internal part having lamellae of differing thicknesses and lengths, each of said lamellae being tapered and having a tip and a base, said tip being thinner than said base.

10. The anti-noise panel according to claim 9, said at least one damper being formed of a thermoplastic elastomer.

11. The anti-noise panel according to claim 9, said damper being formed of the thermoplastic material.

12. The anti-noise panel according to claim 11, said at least one damper having a pyramid shape that protrudes inwardly of said inner cavity.

* * * * *